United States Patent [19]

Virk et al.

[11] Patent Number: 4,600,562

[45] Date of Patent: Jul. 15, 1986

[54] METHOD AND APPARATUS FOR FILTERING ENGINE EXHAUST GAS

[75] Inventors: Kashmir S. Virk, Hopewell Junction; Michael A. Caggiano, Chelsea; Roger L. Leisenring, Jr., Hopewell Junction, all of N.Y.

[73] Assignee: Texaco Inc., White Plains, N.Y.

[21] Appl. No.: 686,163

[22] Filed: Dec. 24, 1984

[51] Int. Cl.[4] ..... F01N 3/10

[52] U.S. Cl. ..... 422/180; 60/302

[58] Field of Search ..... 422/176, 179, 180, 177, 422/182, 183; 60/299, 302; 29/157 R; 431/268

[56] References Cited

U.S. PATENT DOCUMENTS

| | | | |
|---|---|---|---|
| 3,770,389 | 10/1973 | Kitzner et al. | 422/180 X |
| 3,988,113 | 10/1976 | Roberts et al. | 422/177 |
| 4,008,570 | 2/1977 | Harada | 422/180 X |
| 4,125,380 | 11/1978 | Negola | 422/180 |
| 4,175,107 | 11/1979 | Iwaoka et al. | 422/180 X |
| 4,225,561 | 9/1980 | Torres | 422/180 X |
| 4,360,957 | 11/1982 | Eng | 29/157 R |

*Primary Examiner*—Richard L. Chiesa

*Attorney, Agent, or Firm*—Robert A. Kulason; James J. O'Loughlin; Robert B. Burns

[57] ABSTRACT

A filter for treating a particulate containing exhaust gas stream being discharged from an internal combustion engine. The filter includes a compressible bed through which the exhaust gas flows, said bed being comprised of a mass of randomly disposed metallic fibers which define particulate retaining flow passages. The bed is formed with at least one segment being compressed to a greater density than other similar segments whereby to effect a desired gas flow path through the respective bed segments, and a more uniform distribution.

10 Claims, 8 Drawing Figures

AMOUNT OF PARTICULATES TRAPPED ON DEF & EXOTHERMIC TEMPERATURE PEAKS DURING REGENERATION

METHOD AND APPARATUS FOR FILTERING ENGINE EXHAUST GAS

BACKGROUND OF THE INVENTION

With any internal combustion engine it is desirable that exhaust gases be treated so that they can be safely discharged into the atmosphere. In some engines, particularly of the diesel type, among the most prevalent operating problems is the presence of particulates of varying size, which are carried in the exhaust gas stream.

The particulates are normally bits of carbon. They result from the incomplete combustion of hydrocarbon fuels under certain engine operating conditions. However, the operating efficiency of the engine is also a contributing factor to the amount of carbon produced.

The presence of relatively large amounts of carbon particles in any exhaust gas stream is evidenced by a dark, smoky, undesirable effluent. Such smoke is not only offensive aesthetically; in large quantities it can be unhealthy. The problem is most evident in the operation of diesel engines.

Means have been provided and are known to the prior art, for the elimination or minimization of the particulate content in exhaust discharge streams. It is known, for example, particulates can be eliminated by a suitable smoke filter of proper construction. Eventually, however, the latter can become saturated and/or inoperable, a result that stems from excessive particulate accumulations which block flow passages.

It is further known that the overall engine exhaust gas treating process can be expedited to a degree. This is achieved primarily by passing the hot gas stream through a filter medium, a process which is expedited by providing the filter with a catalyst which is capable of promoting combustion of retained particles.

It should be appreciated that the generation of carbon particles is prevalent under virtually all diesel engine operating conditions. It is further appreciated that the quality of an exhaust gas stream in any internal combustion engine will vary in accordance with the immediate operating characteristics of the engine.

For example, the temperature range experienced by a diesel exhaust gas stream can vary between slightly above ambient air temperature, to temperatures in excess of 1200° F. When the exhaust gas is hot enough, the carbon particles trapped in a filter will, upon contact with the hot gas, be combusted and the filter rejuvenated. However, in diesel powered passager cars, engine operating conditions under which this automatic rejuvenation can occur is seldom reached.

Where it is determined that an engine continuously operates under circumstances that the particulates are continuously produced and accumulated in the filter, the particulate retaining bed must be occasionally rejuvenated.

Under some circumstances, and as noted above, rejuvenation will consist of merely introducing the hot exhaust gas stream, containing sufficient oxygen, into the filter bed to contact and ignite the retained carbon particles. The combustion of any large and confined carbon accumulation tends to produce temperatures greatly in excess of that of the exhaust gas. The result is that at such excessively high tempeatures, parts of the filter bed or even the filter casing are susceptible to thermal shock, damage or distortion.

Stated otherwise, the filter bed, when formed of metallic fibers or of a similar filter media, is constructed in a manner to be characterized by a sufficient fiber density to remove solid particulate matter. The filter mass, however, should not be so dense as to establish too great a back pressure against the source of the gas.

To withstand the high temperatures which can be expected in internal combustion engine operation, the filter media here contemplated is preferably formed of metallic fibers such as stainless steel or the like. Such fibers are capable of being readily bent or deformed. Thus, a mass of randomly disposed fibers can be compressed to a desired density, received within a reaction chamber, and perform the desired particulate removing function. The degree to which it is compressed will determine the size of the gas flow passages therethrough.

When a filter bed of metallic fibers is utilized in an exhaust gas treatment system, the hot gas stream will tend to follow the path of least resistance from the casing inlet to the outlet. As a general rule, for a uniform density filter bed, this path will be through the center of the bed, or along a path determined by the relative positioning of the inlet and outlet.

As a consequence, the bed's outer or peripheral edges will receive a minimal amount of retained particulate matter. As a further consequence, the particulate accumulations will be concentrated in those areas or those parts of the bed where gas flow is most concentrated.

During the rejuvenation period when the combustible accumulations are burned off, the thermal intensity of incineration will be concentrated at certain parts of the bed. Thus, while the rejuvenation process is found to be successful, it might have been achieved at the expense of the parts of the bed which have been permanently deformed or otherwise thermally damaged due to prolonged exposure to the excessive heat.

This thermal damage is most noticeable at the downstream end of the gas's flow path. Generally, the filter bed will be found to have developed a conically shaped defective area adjacent to the filter casing outlet. It results from the combined effect of the incineration combustion, together with the hot exhaust gas as the latter becomes progressively heated while transversing the filter bed.

Toward overcoming the stated problems endemic to exhaust gas filters, there is presently provided a filter having a bed formed of randomly disposed and compressed metallic fibers. The latter are sufficiently compacted to define a plurality of passages through which the hot exhaust gas will flow.

The physical composition of the overall bed is relatively uniform. However, the packed density of the mass is varied in different segments of the bed. Thus, the exhaust gas flow path through the respective bed passages, in following a path of minimal resistance will urge much of the stream toward the filter's peripheral edges.

It is therefore an object of the invention to provide an effective exhaust gas filter for removing particulate combustible matter from an exhaust gas stream.

A further object is to provide an exhaust gas filter which can be safely rejuvenated without jeopardizing the integrity of the filter medium.

Another objective is to provide a filter which utilizes a frangible though compressible filter media which has the capability of being compressed to a desired density whereby to regulate the gas flow path through the filter bed.

DESCRIPTION OF THE DRAWINGS

Referring to FIG. 1, to facilitate description of the instant filter and its mode of operation, an internal combustion engine 10 or other source of exhaust gas will be considered to be of the diesel type. In the latter, air is sequentially introduced from an air filter 11, by way of a manifold 12, to the engine's various combustion chambers.

Figure 1:
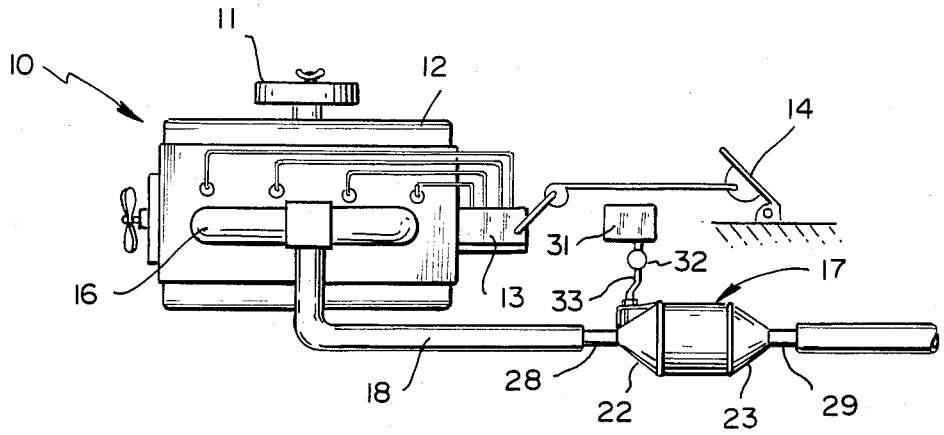
FIG. 1 illustrates an internal combustion engine to which the presently contemplated filter is connected to receive exhaust gas.

Diesel fuel is thereafter injected in controlled amounts into each combustio chamber from a fuel pump 13. Fuel flow rate is regulated by control linkage 14 which can be depressed by an operator's foot.

The hot exhaust gas stream is led from exhaust manifold 16 and conducted through an exhaust pipe 18 to a smoke filter 17. Although a sound absorbing muffler could be inserted into the exhaust pipe, such an element is ancillary to, and not particularly relevant to, the instant and not as sensitive to the instant system and its method of opeation with respect to filtering exhaust gas.

The exhaust gas stream subsequent to leaving exhaust manifold 16 will usually be at a temperature within the range of about 200° to 1200° F. The precise temperature will depend, as herein noted, on the particular operating conditions and the efficiency of the engine.

Figure 2:
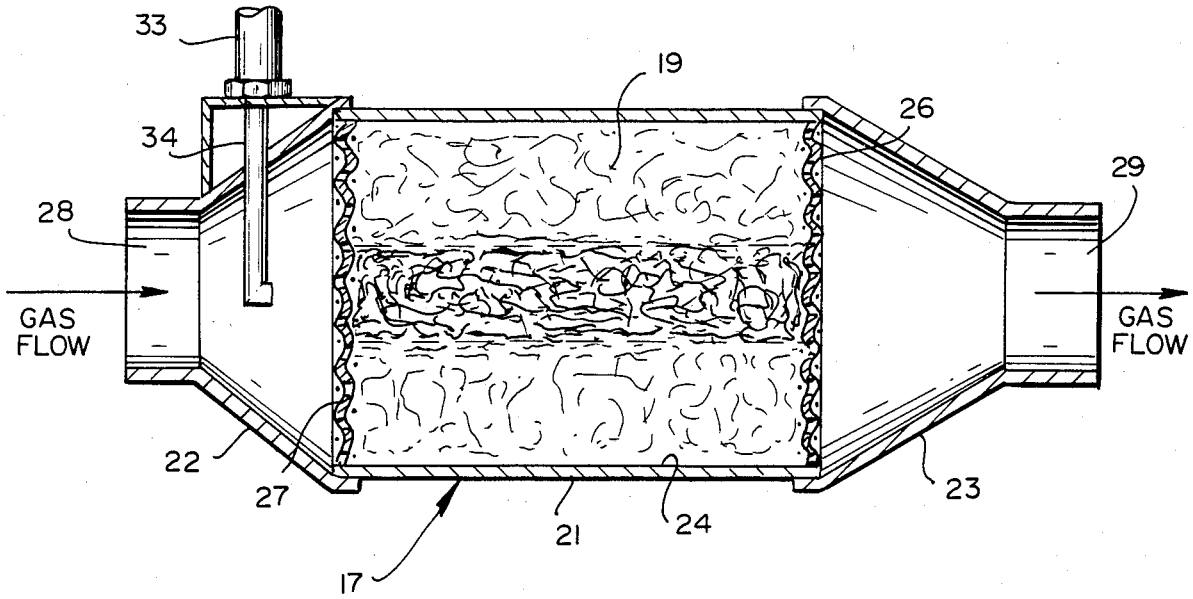
FIG. 2 is an enlarged cross-sectional view of the filter shown in FIG. 1.

For example, at low and idle speeds, exhaust gas will be relatively cool or only moderately heated. Consequently, and referring to FIG. 2, as the particle laden exhaust gas stream enters filter 17, the particulates will be retained along the many diverse passages within the composite filter bed 19.

The hot exhaust gas is comprised primarily of a combination of gases. Normally, however, it embodies sufficient oxygen content to support at least a limited degree of combustion within the stream itself.

Referring again to FIG. 2, in one embodiment, filter 17 comprises an elongated metal casing 21 having opposed end walls 22 and 23 which define an internal reaction chamber 24. The latter chamber is occupied to a large extent by composite filter bed 19 formed as will be hereinafter noted, particularly to provide multi-density segments which define a plurality of varied sized flow passages therethrough.

The primary function of bed 19 is to define multitudinous irregular passages along which hot exhaust gas will flow. During the initial or deposition cycle, particulate matter carried on the exhaust gas stream will be retained on the various passage walls of bed 19. After a period of time a second cycle will commence to in effect cause the incineration of the retained combustible particles. The latter, as noted, are normally carbon which will combust to gaseous form and be discharged through the filter downstream end.

Bed 19 is preferably supported at its upstream and downstream ends by perforate panels 26 and 27 or similar members. These panels can take the form of screens or other similar rigid, gas permeable transverse members. The panels are positioned or removably held in casing wall 21 to support against displacement the one or more segments of bed 19, particularly when the latter become weakened as a result of contact with the rapidly flowing hot exhaust gas.

The filter upstream end wall 22 is provided with an inlet port 28 for introducing exhaust gas to the upstream side of bed 19. In a similar manner, conical wall 23 is communicated with a discharge conduit 29 to carry away particulate-free gases which leave bed 19.

In the operation of a normal filter of the type here contemplated, flowing of the particle laden exhaust gas through filter bed 19 will cause an accumulation of the combustible material in and about the bed passages. Over a period of time, the built-up accumulations will cause at least some of the passages to become blocked to the point where the filter will become inoperable or inefficient.

As a matter of practicality it becomes necessary to open or clear these blocked passages, or to rejuvenate the filter by disposing of the combustible particulate matter. It is found that this can be achieved safely through a process of carefully controlled incineration so that the combustible matter passes from the filter in the form of a gaseous discharge.

Among the known ways of instituting incineration of the combustible accumulations, the prior art has taught that the most simple method is to increase the temperature of the exhaust gas prior to, or immediately upon its reaching the filter. This increase can be achieved in any of several ways. One such method includes addition to the exhaust gas stream of a metered amount of a secondary combustible fuel. The latter can take the form of a liquid or even a vapor, and is preferably the fuel being utilized in the engine such as diesel fuel.

In any instance, the combustible secondary fuel is introduced to the exhaust gas stream in a manner and amount to ignite upon contact with the stream or upon contact of the fuel mixture with a catalyst at the upstream end of the filter bed. Thus, as the heated exhaust stream contacts the carbon accumulations the latter will be ignited.

To facilitate the filter rejuvenation cycle, the instant system includes a source of a secondary fuel 31. Metering means 32 communicated with source 31 is provided to periodically inject a measured amount of said secondary fuel through line 33 to an injector 34 which opens into casing wall 22 upstream of bed 19.

Operationally, secondary fuel can be injected at preset intervals, or in response to a condition in the filter which suggests carbon accumulation. Toward this end, the filter can be provided with instrumentation such as thermocouples positioned in bed 19.

The prior art also teaches means for instituting combustion of the collected carbon through the facility of temporarily enriching the fuel mixture to the engine. The exhaust gases will thus be discharged from manifold 16 at a higher temperature without the need for a supplementary fuel.

Figure 3:
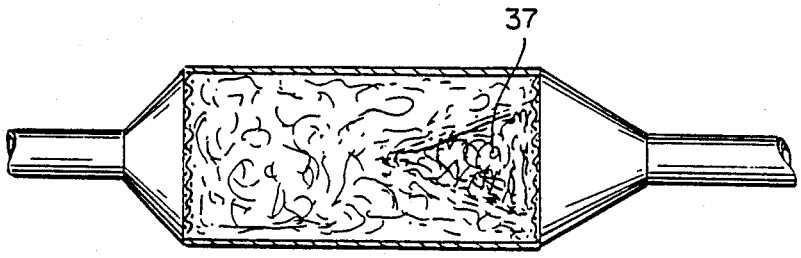
FIG. 3 (PRIOR ART)
FIG. 3 is a cross-sectional view of a typical filter disclosed by the prior art.

In any event, and as shown in FIG. 3, one undesirable effect of igniting the accumulated carbon particles, regardless of how initiated, could result in the aforementioned problem of possible damage to the filter media. Even though the incineration process might be closely controlled, the problem of filter bed 19 damage has not been completely eliminated.

This, as mentioned, is particularly true at the filter discharge side and more particularly in the area adjacent to the filter discharge opening which terminates the hot gaseous flow through the filter bed. In examining filters which have been thermally damaged due to uncontrolled burning of the carbon accumulations, the bed has usually exhibited a generally conical area 37 which progressively narrows from the rear of bed 19, toward the forward end.

Referring again to FIG. 2, filter bed 19 is referred to herein as being a composite bed. This terminology defines the bed as comprised of a number of discrete segments, cooperatively arranged, through which the exhaust gas progressively flows.

The basic filter media contemplated by the applicants for use herein is disclosed in a number of patents including U.S. Pat. No. 4,360,957, King D. Eng. Said media is comprised generally of metallic wires, fibers, or fibrils, which are randomly disposed to form a fibrous mass much in the manner of steel wool. The metallic wires are preferably steel or stainless steel, which wires form a substrate for a subsequently applied surface coating of alumina.

To promote the filtering or rejuvenation action within the filter 17, the alumina layer can be further provided with a coating of a catalytic material. The latter will prompt combustion of a supplementary fuel mixture with the exhaust gas. The primary function of the filter media, whether coated or not, is to retain along the media walls those solid particles which are carried through the tortuous passages of the bed.

The metallic wires are preferably compressed into a fibrous mass to increase the density of the mass to a desired degree. It is appreciated that as a practical matter, the more said fibers are compressed, the greater will be the density of the mass or the filter bed. This factor will, however, increase back pressure against gas flow.

For the present purpose, the density, or the packing density of the fibrous mass will be considered and referred to in terms of grams per liter of volume. For example, a packing density of 350 grams of metallic wire per liter, would provide a bed so compact as to virtually preclude gas flow therethrough. This follows due to the minimal size of the passages between the compressed filter wires. A filter of this caliber would be of little or no value in the treating of an automotive gaseous stream.

On the other hand, a packing density of approximately 100 grams per liter would form a series of passages so large as to be relatively ineffective in retaining solid particulate matter. In such an instance, the solids would be carried through filter bed 19, which solids would then be discharged into the atmosphere along with the hot exhaust gas.

In the disclosed arrangement, the various segments of composite filter bed 19 are arranged to effect a desired flow path. Thus, the packing density of adjacent segments of bed 19 will vary to assure that the overall gas flow follows a desired path. This path, as herein mentioned, will be such as to urge at least part of the flow toward the outer, cooler parts of bed 19 rather than permitting the flow to gravitate toward a fixed path in alignment with the casing respective inlet and outlet means.

Frequently a filter casing of the type presently contemplated is formed in a cylindrical or oval shape to best be utilized for a particular application. For example, when the filter unit is to be used on a passenger vehicle, it will normally be placed at the underside of the vehicle. Further, it will be shaped to minimize its closeness to the ground. Thus, the filter casing will be conformed preferably into a general oval shape with the gas inlets and outlets positioned at the casing opposed ends.

If practical, the inlet and outlet openings will be disposed in substantial alignment relative to the filter casing. However, the configuration of the particular automobile body and frame may be such as to warrant the positioning of the inlet and outlet in a manner that they are unaligned. They will therefore be arranged to best accommodate other connectors or conduits in the exhaust gas system.

Figure 4:
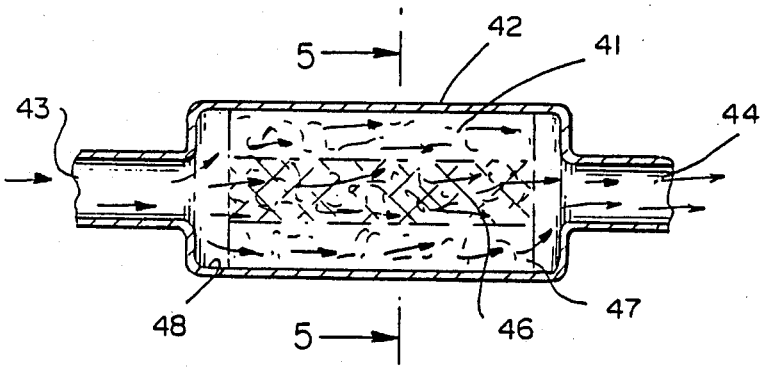
FIGS. 4 and 5 illustrate schematically by way of cross-sectional views, the flow of gas through the unit.
Figure 5:
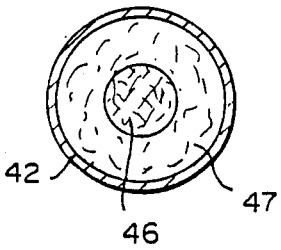

In one embodiment of the disclosed filter, and referring to FIGS. 4 and 5, a fibrous mass as herein described was formed into the composite bed 41. Bed 41 was formed into the composite arrangement of segments which were slidably positioned within a closed casing 42. FIG. 4 is shown primarily schematically to best illustrate positioning of the composite bed 41 within the casing reaction chamber rather than to accentuate other details of the casing's structure.

Cylindrical casing 42 thus includes an inlet means 43 at one end, and an outlet 44 at the other or discharge end. The respective inlet and outlet are in substantial alignment and extend coaxially of the cylindrical casing's longitudinal axis.

Bed 41 is comprised of an inner core segment 46 which is formed of randomly disposed metallic fibers having an alumina surface coating. In the present arrangement, and for testing purposes, the fibers are compressed to a density of about 250 grams of fiber per liter of volume.

The outer segment 47 of bed 41 is disposed concentric with inner segment 46 and is formed similarly of alumina coated wires. This latter mass of fibers, however, was compressed to a packed density of approximately 50 grams per liter and completely enclosed the periphery of the inner core segment 46.

The two bed segments are preferably closely fitted or contiguous one to the other to avoid the presence of larger intermediate passages which could permit bypassing of the exhaust gas to avoid the filtering section. Further, external segment 47 is of a sufficient size outer dimension to closely and preferably to slidably fit within the inner walls of the casing 42. Bed 41 thus lies contiguous with the inner walls of the casing to avoid the possible formation of peripehral openings or voids which would likewise allow exhaust gas to bypass the filter bed.

In this illustrated example, the cross-sectional area ratio between inner segments 46 and outer segment 47 was approximately one to two. As shown by the directional arrows in FIG. 4, the carbon particle carrying exhaust gas upon entering chamber 48 of casing 42 will encounter the more densely packed inner segment 46. However, since the less densely packed outer segment 47 will offer flow resistance to a lesser degree, there will be a propensity for the exhaust gas to move outwardly through the less resistant passages of segment 47.

With the disclosed structure, the degree of particle accumulation will not be concentrated within inner segment 46, but will be dispersed more evenly throughout the entire composite bed 41. Thereafter, during the incineration cycle, during combustion of the particle accumulations, much of the carbon will be in the outer bed segment. The latter will thus be more capable of dissipating the heat of combustion to the surrounding metal casing 42.

Figure 6:
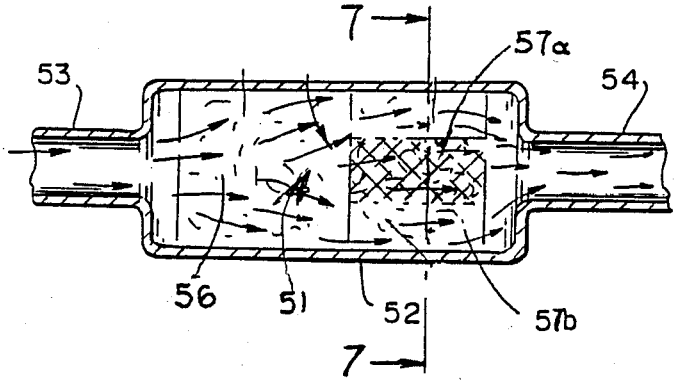
FIGS. 6 and 7 are similar to FIGS. 4 and 5.
Figure 7:
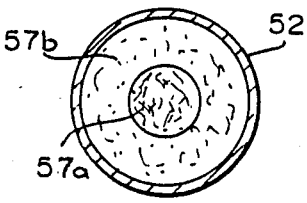

In a further embodiment of the disclosed filter, and as shown in FIGS. 6 and 7, composite bed 51 is positioned within cylindrical casing 52 having aligned inlet and outlet means 53 and 54 respectively. Bed 51 as shown is formed in two contiguously positioned cylindrical portions 56 and 57. Forward section 56 is comprised entirely of randomly disposed alumina covered wires which are formed to a uniform packed density of approximately 150 grams per liter.

The secondary filter section 57 is comprised of two concentric segments 57*a* and 57*b* which exhibit a packing density differential. The inner or core segment 57*a* is formed with a density of approximately 250 grams per liter. The surrounding outer segment 57*b* is formed with a packed density of approximately 150 grams per liter, comparable to the density of forward segment 56.

A filter following the composition of that shown in FIGS. 6 and 7 was fabricated and subjected to a comparative filtering and rejuvenating test. The test was conducted to determine the amount of particulates which could be accumulated and safely disposed of through incineration. This was compared with a filter operated under similar circumstances, but having the normal unitary packing density of filter media in the bed as shown in FIG. 3.

Figure 8:
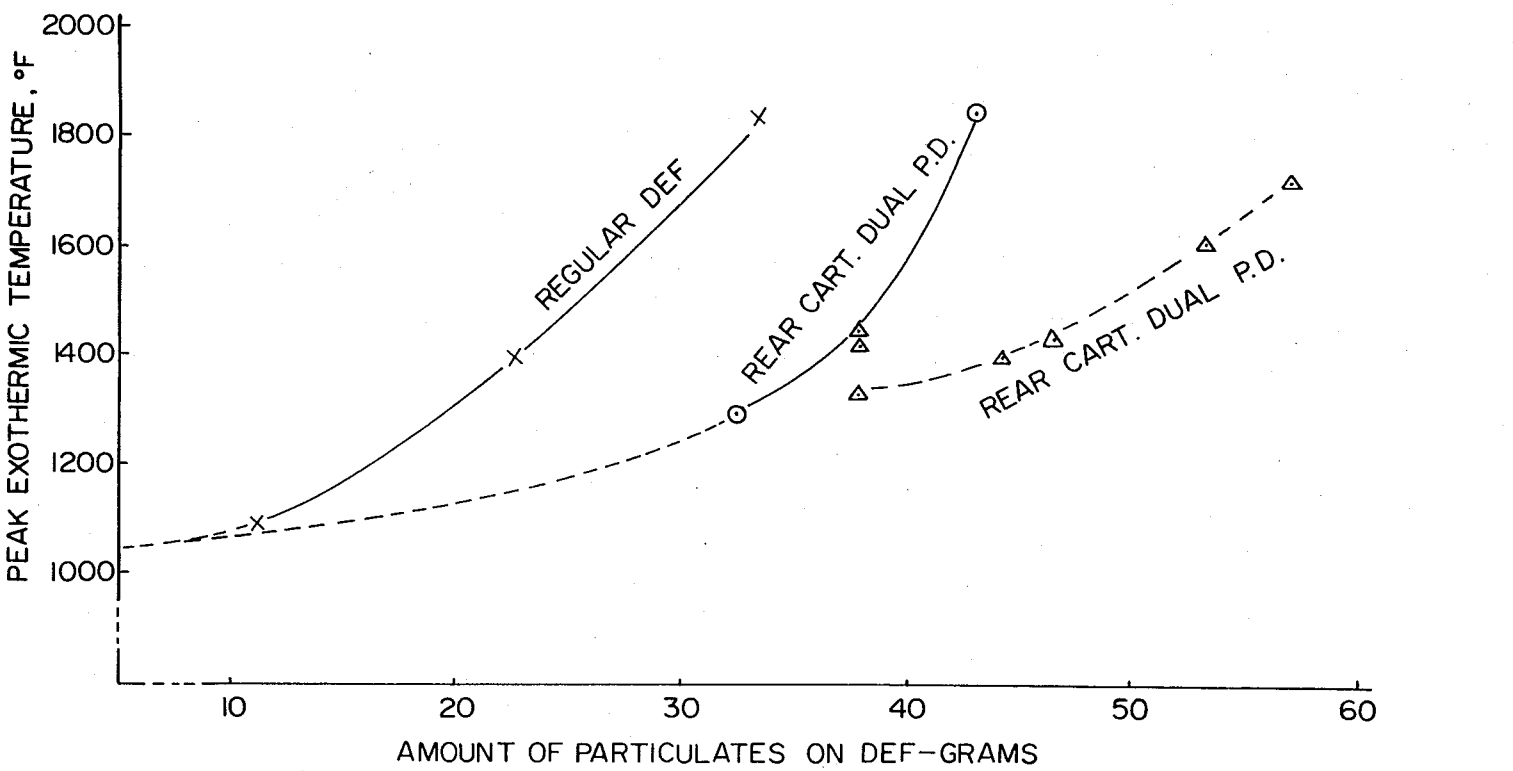
FIG. 8 is a graphical representation of filter test data.

FIG. 8 represents a graphical comparison of the data accumulated utilizing three different filter constructions. Each of the filter units, after accumulating particulates, form a diesel engine exhaust stream operated during regeneration to a peak exothermic temperature of approximately 1800° F.

In the instance of the regular diesel exhaust filter (FIG. 3), wherein the bed filter media packing density was uniform at 200 grams per liter throughout, the amount of particulates handled was approximately 33 grams.

Under similar operating conditions, a filter as shown in FIGS. 6 and 7, was provided wherein the packing density of the rear segment 57 of the composite filter bed was 200 and 100 grams per liter for the inner segment 57*a* and outer segment 57*b*, respectively. In this instance, incineration of accumulated carbon to an exothermic temperature of approximately 1800° F. was found to accommodate approximately 40 grams of carbon in contrast to the previous 33 grams as with the ordinary uniform packing density filter.

In the third instance as illustrated by the curve identified as Rear Cart. Dual P.D., a filter arrangement as shown in FIGS. 6 and 7 was again utilized. Here the relative packing densities of inner core segment 57*a*, and outer segment 57*b* were 250 and 150 grams per liter, respectively. As shown, for an exothermic temperature of about 1700° F., the amount of particulates incinerated was approximately 56 grams.

In both instances of the composite filter, the ratio of core segment volumes is one-third to two-thirds.

In summary, it is clear that the presently disclosed arrangement in a casing of the multi-density filter bed does promote a dispersed flow path of exhaust gas through the filter. The dispersion will permit effective removal of carbon particles from the gas stream, and the further controlled incineration of the particles without damage to the filter structure.

It is further understood that although modifications and variations of the invention may be made without departing from the spirit and scope thereof, only such limitations should be imposed as are indicated in the appended claims.

We claim:

1. A filter for treating a stream of hot exhaust gas which carries an amount of combustible particulate matter from an internal combustion engine, and which filter includes means to incinerate the said particulate matter into gaseous state prior to discharge of the treated exhaust gas into the atmosphere, which filter further includes;

an elongated casing which defines a reaction chamber having an inlet communicated with a source of said hot exhaust gas, and a casing outlet, a composite, elongated cylindrical filter bed positioned in said reaction chamber defining varying sized particulate retaining passages through which said hot exhaust gas flows, said composite filter bed comprising a unitary body formed of randomly disposed metallic fibers which are compacted into a compressibly resilient fibrous mass to form said varying sized particulate retaining passages through the mass, said fibrous mass including a plurality of concentrically arranged discrete segments, at least one segment of which is characterized by a metallic fiber density greater than the metallic fiber density of other discrete segments in the mass, whereby the flow pattern of hot exhaust gas flowing through the filter bed will be influenced to follow a path of least resistance through said other discrete segments, and to direct hot gas in an outwardly direction toward the casing, prior to passing through the casing outlet.

2. In a filter as defined in claim 1, wherein said composite filter bed is comprised of randomly disposed steel fibers.

3. In a filter bed as defined in claim 1, wherein said composite filter bed is comprised of randomly disposed alumina coated steel wires.

4. In a filter bed as defined in claim 1, wherein said randomly disposed metallic fibers are coated with a catalytic material.

5. In a filter as defined in claim 1, wherein said composite filter bed comprises a metallic fibrous mass in which an elongated inner segment thereof is characterized by a fiber density which is greater than the fiber density of an outer segment which surrounds said inner segment.

6. In a filter as defined in claim 5, wherein said elongated inner segment extends substantially the entire length of the metallic fibrous mass.

7. In a filter as defined in claim 6, wherein said elongated inner segment extends partially through the fibrous mass.

8. In a filter as defined in claim 1, wherein at least one segment of the fibrous mass is characterized by a greater metallic fiber density than other of said segments and is disposed adjacent to and in substantial alignment with the casing outlet.

9. In a filter as defined in claim 1, wherein the metallic fiber densities of the discrete bed segments are within the respective ranges of 100 and 350 grams of metallic fibers per liter of volume.

10. In a filter as defined in claim 1, wherein the metallic fiber density of the respective discrete bed segments is within the respective ranges of approximately 150 and 250 grams per liter of volume.

* * * * *